US006743023B2

(12) United States Patent
Topolski

(10) Patent No.: US 6,743,023 B2
(45) Date of Patent: Jun. 1, 2004

(54) SWIM STROKE TRAINER

(76) Inventor: Thomas G. Topolski, 5358 Discovery, S.E., Kentwood, MI (US) 49508

( * ) Notice: Subject to any disclaimer, the term of this patent is extended or adjusted under 35 U.S.C. 154(b) by 0 days.

(21) Appl. No.: 10/064,416

(22) Filed: Jul. 11, 2002

(65) Prior Publication Data

US 2004/0009458 A1 Jan. 15, 2004

(51) Int. Cl.[7] ..... G09B 19/00; A63B 31/10

(52) U.S. Cl. ..... 434/255; 441/56; 441/58; 441/59

(58) Field of Search ..... 434/254; 441/55, 441/56, 57, 58, 59

(56) References Cited

U.S. PATENT DOCUMENTS

| | | | | | |
|---|---|---|---|---|---|
| 1,546,670 | A | * | 7/1925 | O'Sullivan | 441/58 |
| 1,715,571 | A | * | 6/1929 | Robertson | 441/58 |
| 1,754,704 | A | * | 4/1930 | Wilcox | 441/58 |
| 3,097,375 | A | * | 7/1963 | Griffith | 441/57 |
| 3,146,470 | A | * | 9/1964 | Hamblin | 441/58 |
| 4,300,759 | A | * | 11/1981 | Caplan | 482/111 |
| 4,521,011 | A | * | 6/1985 | Solloway | 482/111 |
| 4,752,699 | A | * | 6/1988 | Cranford et al. | 327/100 |
| 4,913,418 | A | * | 4/1990 | Schlueter et al. | 482/55 |
| 4,964,827 | A | * | 10/1990 | Rudy | 441/59 |
| 5,304,080 | A | * | 4/1994 | Dilger | 441/58 |
| 5,664,981 | A | * | 9/1997 | Lillo | 441/114 |
| 5,700,173 | A | * | 12/1997 | Lerro | 441/57 |
| 6,019,650 | A | | 2/2000 | Rives et al. | 441/58 |

OTHER PUBLICATIONS

Catalog entitled, *Kiefer, Everthing but the Water since 1947!*, pp. 60, 61, 68 and 69, published Spring 2002.

* cited by examiner

*Primary Examiner*—Kurt Fernstrom
(74) *Attorney, Agent, or Firm*—Van Dyke, Gardner, Linn & Burkhart, LLP

(57) ABSTRACT

A swim stroke trainer apparatus and method includes providing a forearm paddle adapted to be connected to a swimmer's forearm to promote a downward motion of the hand and forearm and a bicep/tricep float adapted to be connected with a swimmer's upper arm to promote an elevated elbow.

19 Claims, 8 Drawing Sheets

SWIM STROKE TRAINER

BACKGROUND OF INVENTION

This invention relates to techniques for teaching swimming and, more particularly, to a method and apparatus for training a swimmer into the proper catch phase of the swimming stroke.

Various training systems and drills have been provided that work to improve the streamlining of the swimmer in the water. However, it is the catch phase of the swimming stroke that can make the difference between competitive swimmers.

SUMMARY OF INVENTION

The present invention provides a method and apparatus for properly positioning the hand and arm during the catch phase of a swim stroke, in order to train for freestyle, butterfly, breaststroke, backstroke, and the like.

A swim stroke trainer method and apparatus, according to an aspect of the invention, includes providing a bicep/tricep float, including a floatation mass adapted to be connected with a bicep/tricep portion of a swimmer's arm. The bicep/tricep float elevates the elbow, thereby discouraging improper dropping of the elbow during the initiation of the catch. However, the bicep/tricep float may be streamlined to be easily moved through the water as the swimmer moves through the remaining portions of the catch.

The floatation mass may include two or more arcuate portions and at least one strap interconnecting the at least two arcuate portions around the bicep/tricep portion of the swimmer's arm.

A swim stroke trainer apparatus and method, according to another aspect of the invention, includes providing a forearm paddle that is adapted to be connected with a swimmer's forearm. The forearm paddle promotes a downward motion of the hand and forearm. The forearm paddle may include a fin. As the swimmer propels the forearm, the fin converts the swimmer's motion into a downward force leading the forearm downward into a desirable catch position. The forearm paddle may include a throat having a resistance surface for increasing the normal area of the forearm and providing added resistance or feel of the water. The fin may slope downwardly or upwardly from the throat or may be located in any other position of the throat. The throat may be sized to support the hand and the wrist, thereby reducing hand motion to propel the swimmer in order to train the swimmer to use forearm motion, not hand motion. The throat may be designed to limit hand motion, such as to approximately 12 degrees.

The forearm paddle may further include a stabilizer for stabilizing the hand. The stabilizer may be a member gripped by the hand. For comfort, the member may be laterally included to assume a normal hand posture with the hand turned somewhat outwardly. The forearm paddle may be connected with a swimmer's forearm by a first connector. The first connector may be one or more straps. In order to train the swimmer in use of both arms to achieve a proper catch, a pair of bicep/tricep floats may be provided, one for each of the arms of the user. A pair of forearm paddles may be provided, one for each arm of the user.

A method of training swimming, according to an aspect of the invention, includes providing a bicep/tricep float and using said float to discourage dropping of the swimmer's elbow and providing a forearm paddle and forcing the swimmer's forearm down with the paddle while limiting force supplied with the swimmer's hand.

These and other objects, advantages and features of this invention will become apparent upon review of the following specification in conjunction with the drawings.

DESCRIPTION OF THE PREFERRED EMBODIMENT

Referring now specifically to the drawings and the illustrative embodiments depicted therein, a swim stroke trainer apparatus 20 includes a forearm paddle 22 adapted to be connected with a swimmer's forearm and a bicep/tricep float 26 adapted to be connected with a swimmer's upper arm 28 (FIGS. 1*a*–4*b*). Although a forearm paddle and bicep/tricep float are illustrated herein on a swimmer's arm, it should be understood that another forearm paddle and bicep/tricep float may be also used on the swimmer's other arm. It should also be understood that certain benefits may be achieved by using forearm paddle 22 without the bicep/tricep float 26, or vice versa.

Figure 1A:
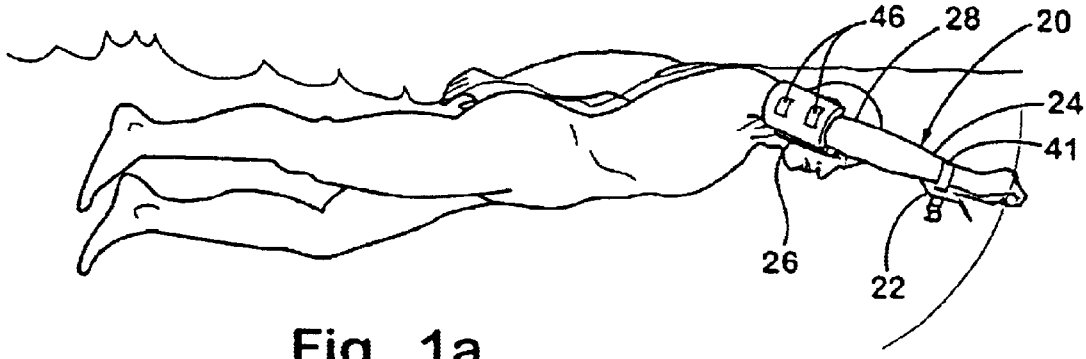
FIG. 1*a* is a side elevation of a swim stroke trainer apparatus and method illustrating the swimmer's arm extended at the beginning of the stroke phase.
Figure 1B:
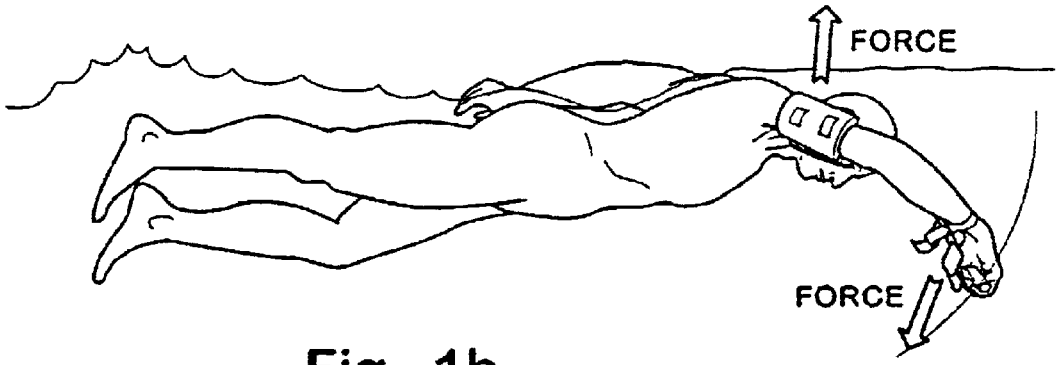
FIG. 1*b* is the same view as FIG. 1*a* of the swimmer's arm at the beginning of the catch phase.
Figure 1C:
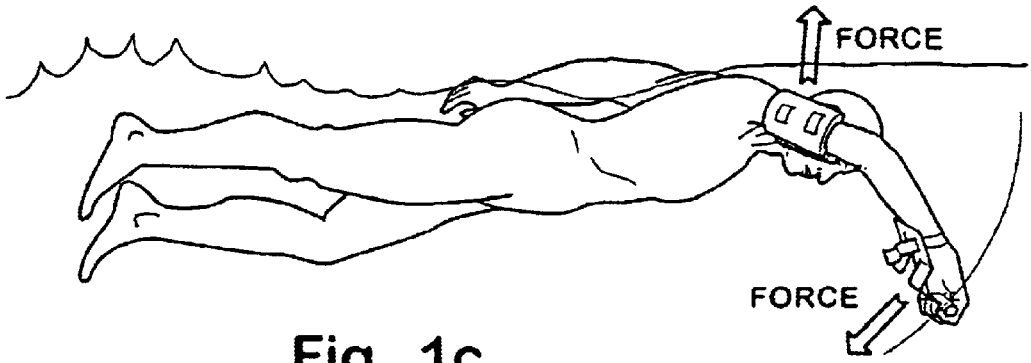
FIG. 1*c* is the same view as FIG. 1*a* of the swimmer's arm near the optimum catch phase.
Figure 2A:
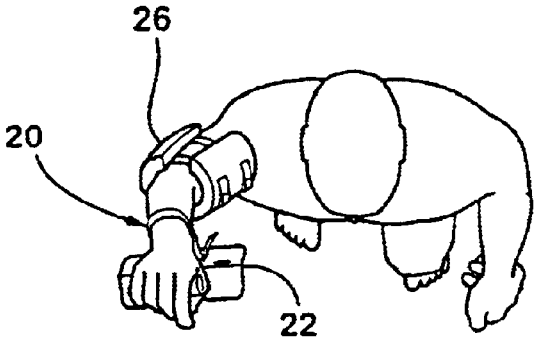
FIG. 2*a* is a front view of a swim stroke trainer apparatus and method illustrating the swimmer's arm extended at the beginning of the stroke phase.
Figure 2B:
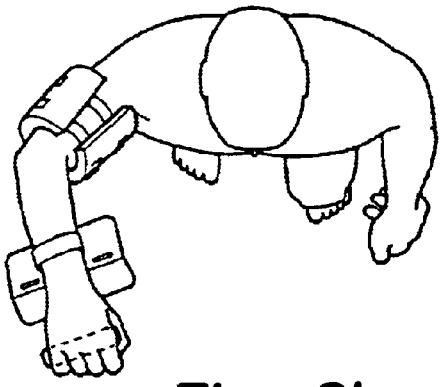
FIG. 2*b* is the same view as FIG. 2*a* illustrating the swimmer's arm at the beginning of the catch phase.
Figure 3:
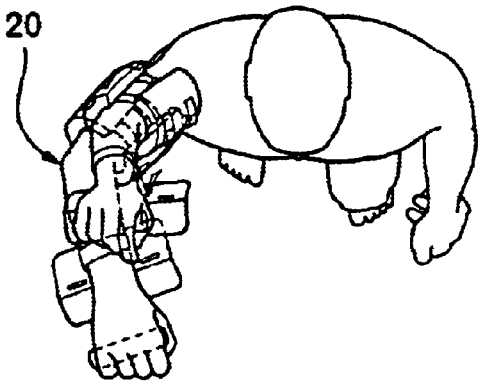
FIG. 3 is a front view of a swim stroke trainer apparatus and method showing a swimmer's arm moving from the beginning of the stroke phase through the beginning of the catch phase.
Figure 4A:
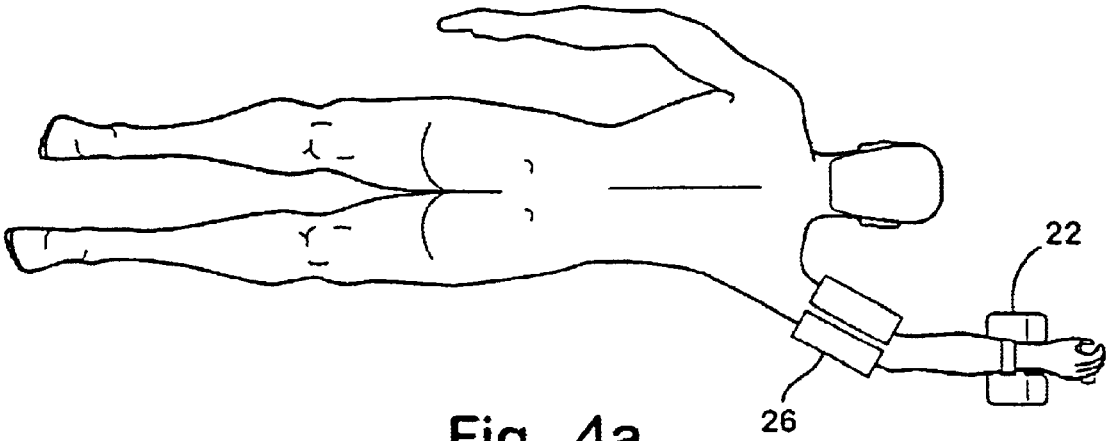
FIG. 4*a* is a top plan view of a swim stroke trainer apparatus illustrating a swimmer's arm extended at the beginning of the stroke phase.
Figure 4B:
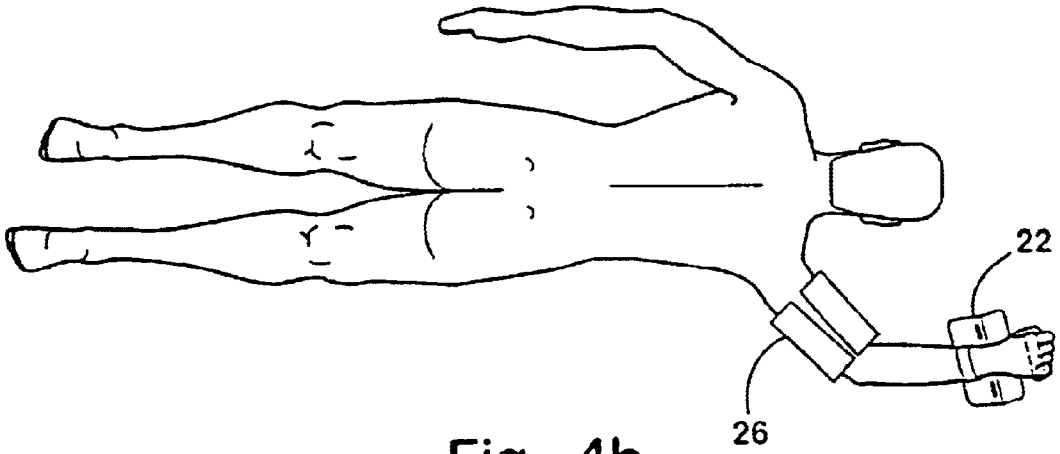
FIG. 4*b* is the same view as FIG. 4*a* illustrating the swimmer's arm at the beginning of the catch phase.
Figure 5:
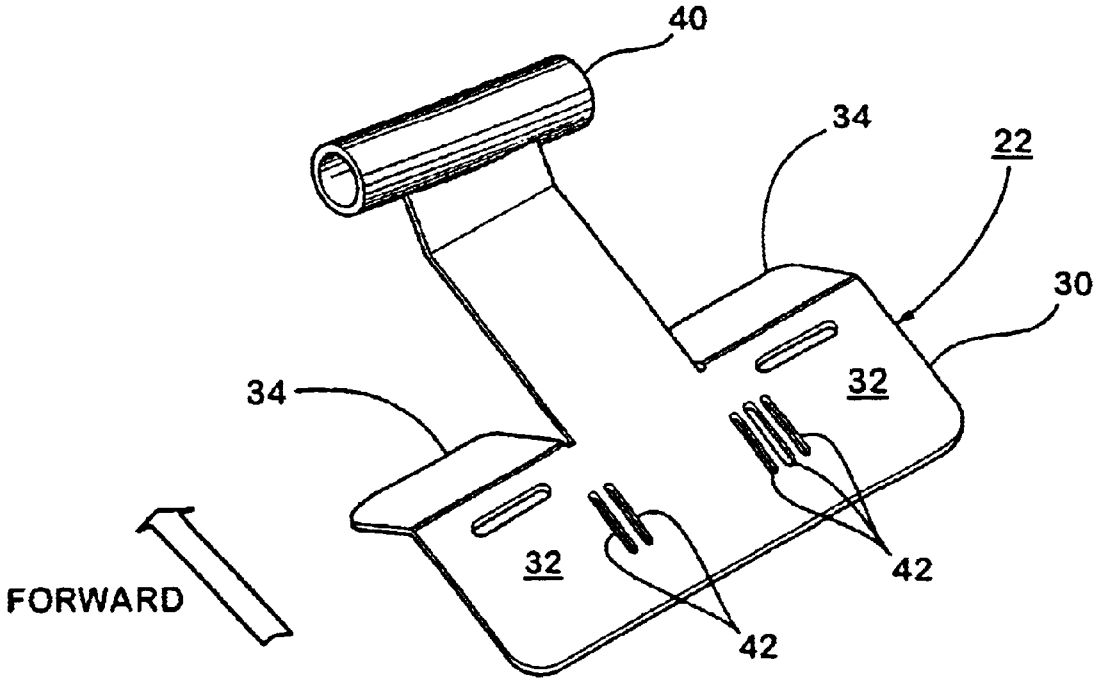
FIG. 5 is a perspective view of a forearm paddle, according to the invention, with connective straps removed to reveal details thereof.

The purpose of swim stroke training apparatus 20 is to develop the swimmer's catch by teaching the swimmer to keep the elbow up and the fingertips down. As the swimmer's arm is extended at the beginning of the stroke phase, as illustrated in FIGS. 1*a*, 2*a* and 4*a*, the swimmer's elbow is supported upwardly by bicep/tricep float 26. However, as will be described in more detail below, bicep/tricep float 26 has a hydrodynamic outer surface which allows the float to be readily dragged under the water and easily moved through the water. As the swimmer's arm is moved during the beginning of the catch phase, as illustrated in FIGS. 1*b*, 2*b* and 4*b*, the elbow is supported upwardly by bicep/tricep float 26 so that the swimmer's arm bends at the elbow. Forearm paddle 22 converts forward motion of the swimmer to a downward force, as will be explained in more detail below, thereby moving the fingertips downward. The forearm paddle may also increase the resistance to the water in order to add a feeling of pressure on the swimmer's forearm. The forearm paddle may also reduce, or limit, forearm bend at the wrist in order to take hand motion out of the swim stroke. As the swimmer's arm nears the optimum catch phase, as illustrated in FIG. 1*c*, the bicep/tricep float 26 encourages the swimmer to keep the elbow up while the fingertips are moved downwardly. Also, as illustrated by comparison of FIGS. 2*a* and 2*b*, 4*a* and 4*b*, and as seen in FIG. 3, forearm paddle 22 additionally limits sideward movement of the forearm.

Figure 6:
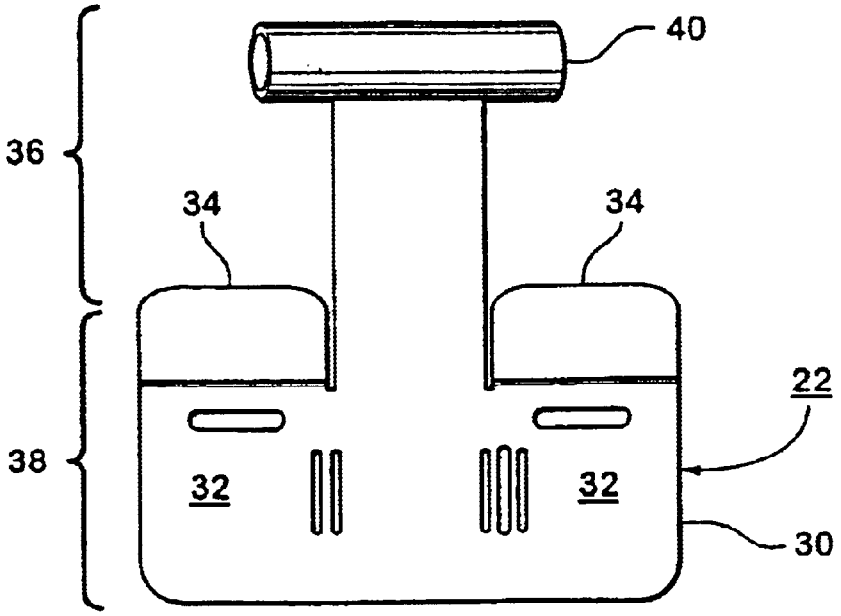
FIG. 6 is a top plan view of the forearm paddle in FIG. 5.
Figure 7:
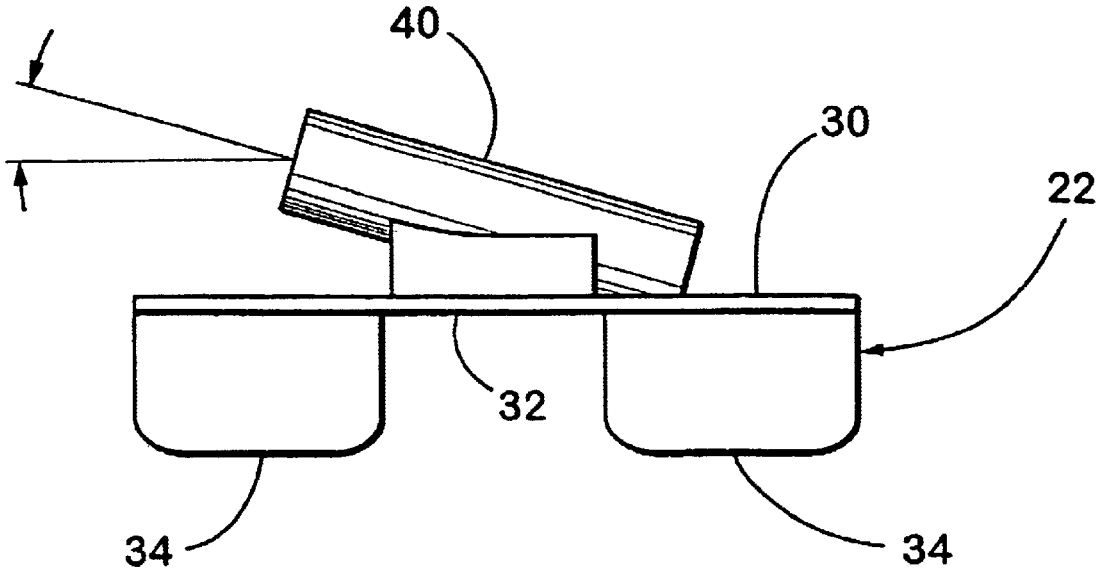
FIG. 7 is a rear elevation of the forearm paddle in FIG. 5.
Figure 8:
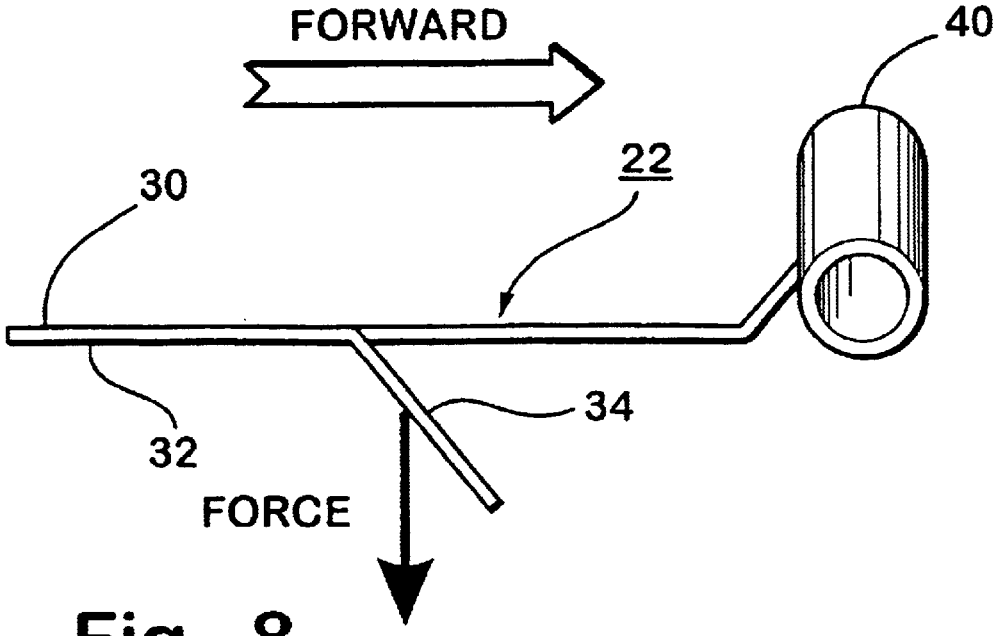
FIG. 8 is a side elevation of the forearm paddle in FIG. 5.

Forearm paddle 22 includes a throat 30 having a resistance surface 32 which extends between the stabilizer grip and the forearm portion and creates resistance and a feel of pressure on the forearm (FIGS. 5–8). A fin 34 extends forwardly at an angle away from the forearm portion and is configured to convert generally forward motion into a downward force, as illustrated in FIG. 8. In this manner, fin 34 promotes movement of the fingertips downward during the catch phase. The forearm paddle may further include a hand portion 36 contacting a swimmer's hand and a forearm portion 38 contacting a swimmer's forearm, as best seen in FIG. 6. By contacting both the swimmer's hand with end portion 36 and the swimmer's forearm with forearm portion 38, forearm paddle 22 limits relative motion between the user's hand and forearm. This limit may be on the order of 12 degrees. This teaches the swimmer to remove hand motion relative to the forearm during the catch phase. Hand portion 36 may include a stabilizer 40 adapted to be gripped by the hand. As best seen in FIG. 7, stabilizer 40 may be laterally inclined in order to have a more relaxed feel to the swimmer. The hand stabilizer would be inclined toward the right for a right-hand forearm paddle, as illustrated in FIG. 7, and toward the left for a left-hand forearm paddle (not shown). A connector 42, which may be in the form of a strap extending around the forearm and through openings 42, may be used to connect with the swimmer's forearm.

Figure 9:
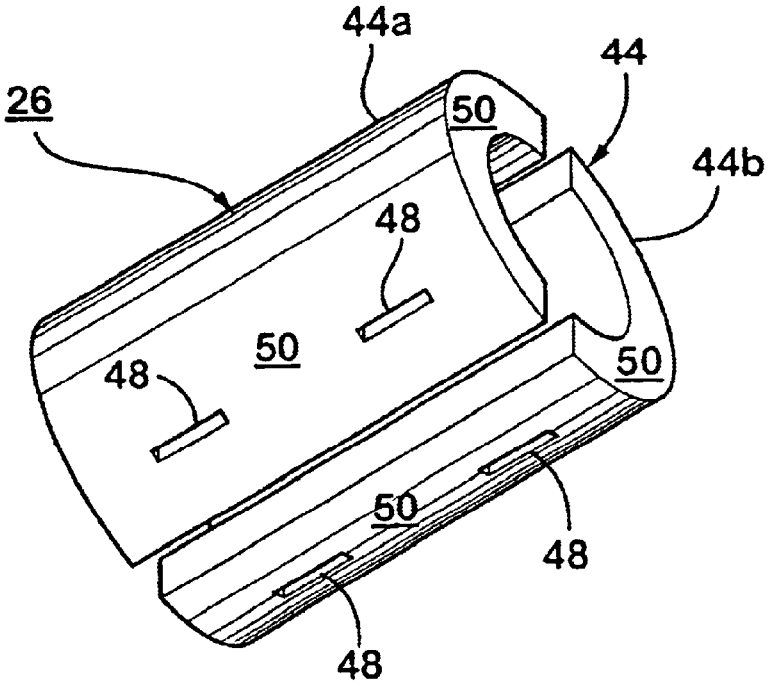
FIG. 9 is a perspective view of a bicep/tricep float, according to the invention, with connective straps removed to reveal details thereof.
Figure 10:
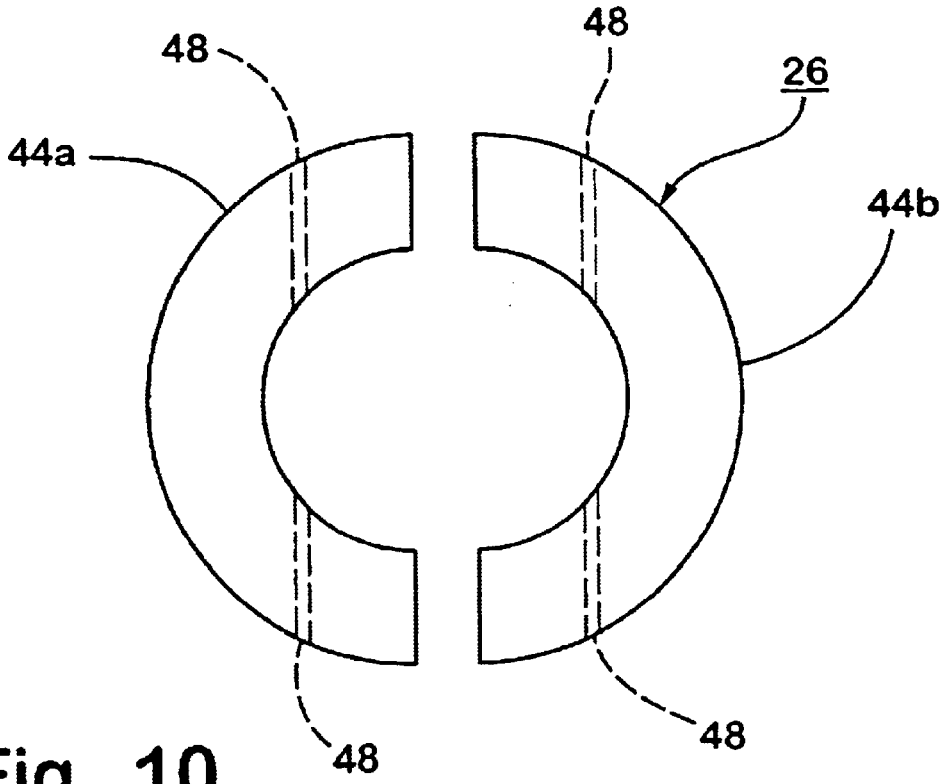
FIG. 10 is an end elevation of the bicep/tricep float in FIG. 9.

Bicep/tricep float 26 includes a floatation mass 44 which, in the embodiment illustrated in FIGS. 9 and 10, is defined by floatation mass portions 44*a* and 44*b*. The providing of floatation mass 44 in separate portions is in order to allow the floatation mass to be placed around the swimmer's upper arm. A connector, such as one or more straps 46, extending through openings 48 connect the floatation mass with the swimmer's upper arm. However, other connectors might be possible. For example, floatation mass portions 44*a*, 44*b* could be immeshed in an expandable fabric which allows the floatation mass to be inserted over the forearm and slid up to the upper arm. Other modifications would suggest themselves to the skilled artisan.

Floatation mass 44 has a hydrodynamic outer surface 50. This allows bicep/tricep float 26 to be easily dragged through the water as the swimmer's arm moves through the catch phase while allowing the elbow to be supported in order to reduce the tendency of the swimmer to lead the catch phase with the elbow.

Figure 11:
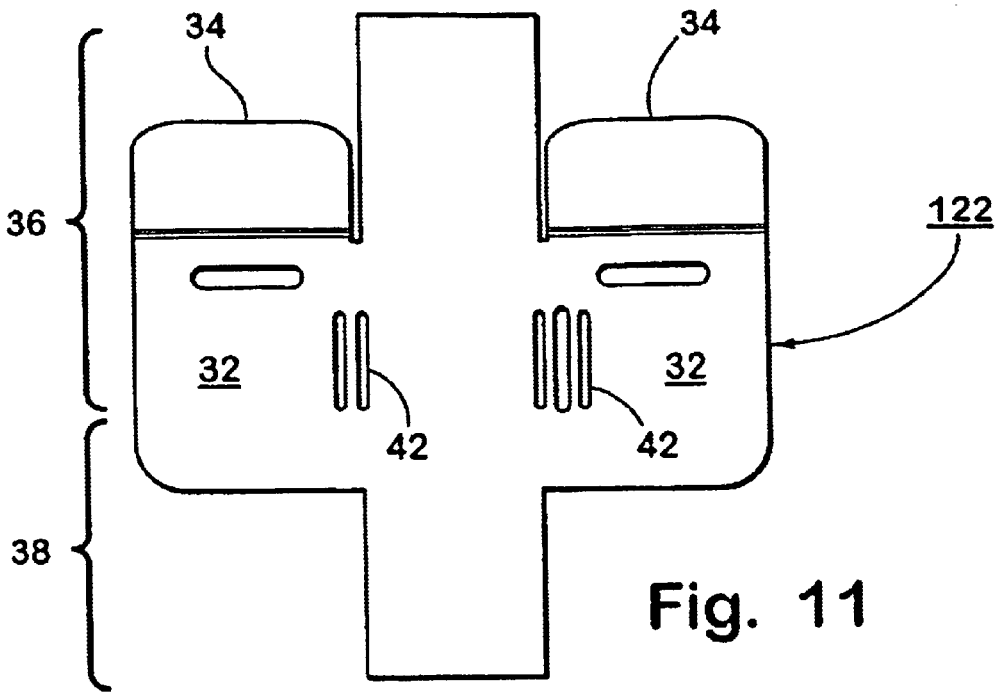
FIG. 11 is the same view as FIG. 6 of an alternative embodiment thereof.

The invention is adaptable to many different embodiments. As illustrated in FIG. 11, a forearm paddle 122 includes a hand portion 136 which includes throat 30. Forearm portion 138 is an extension of throat 30. Forearm paddle 122 is shown without a stabilizer. Forearm paddle 122 would be attached with a connector, such as strap 46 through openings 42 around a portion of the swimmer's hand. Forearm paddle 122 is less preferred because, without the presence of stabilizer 40, the swimmer is more motivated to produce propelling force by the hand. However, because relative motion between the hand and forearm at the wrist is restricted, the swimmer is induced to propel the forearm, not just the hand, during the catch phase.

Figure 12:
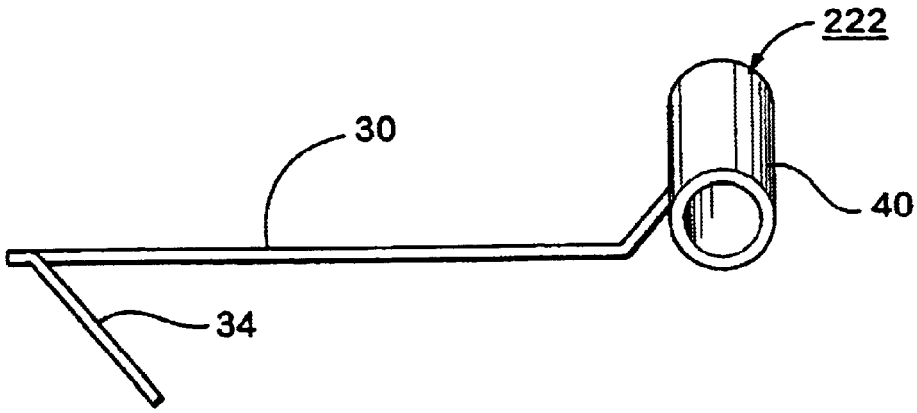
FIG. 12 is the same view as FIG. 8 of an alternative embodiment thereof.
Figure 13:
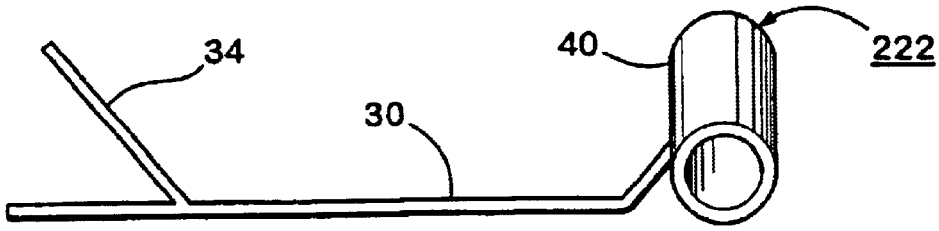
FIG. 13 is the same view as FIG. 8 of an alternative embodiment thereof.

In an alternative embodiment illustrated in FIG. 12, a forearm paddle 222 includes fin 34 extending downwardly from a rear portion of forearm portion 38. In another alternative embodiment illustrated in FIG. 13, a forearm paddle 322 includes a fin 34 which slopes upwardly from forearm portion 38. However, in all instances, a downward force is produced by fin 34.

The swim stroke training apparatus may be accompanied by videotape showing coaches, instructors, parents and swimmers various drills to help novice and beginner swimmers, all the way up to competitive athletes. These drills would show how to most effectively use swim stroke training apparatus 20 to promote better swimming techniques. Thus, the invention is not only intended to enhance the performance of competitive athletes, it is also intended to assist novice and beginning swimmers.

Figure 14:
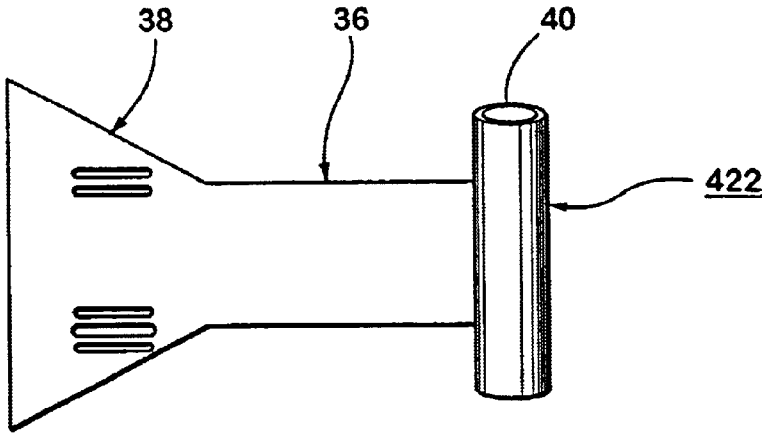
FIG. 14 is the same view as FIG. 6 of an alternative embodiment thereof.

Fin, or foil, 34 works in a manner similar to a windmill to place a force on the forearm. This induces the forearm to go down at the hand. The presence of bicep/tricep float 26 raises the position of the elbow which is important for a good catch. The combination of forearm paddle and tricep/bicep float limits forearm bend and induces the swimmer to not lead with the elbow. Also, the swimmer is induced to swim with the forearm and not the hand. Forearm paddle 22 also reduces sideward movement in the catch phase. Other modifications may suggest themselves to the skilled artisan. For example, in FIG. 14, a forearm paddle 422 having hand and forearm portions 236, 238, respectively, that are provided without a fin. However, the grasping of stabilizer 40 and the reduction of relative motion between the hand and the wrist requires the swimmer to propel the forearm downwardly such that the fingertips will naturally tend to point downwardly during the catch phase.

Figure 15:
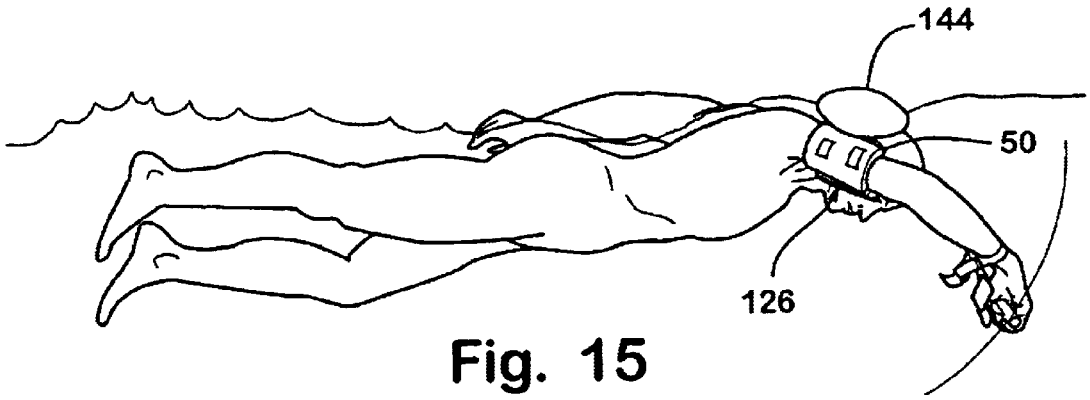
FIG. 15 is the same view as FIG. 1*b* of an alternative embodiment thereof.

Other modifications may suggest themselves to the skilled artisan. For example, as illustrated in FIG. 15, bicep/tricep float 126 may include a cuff 50 fitted around the swimmer's forearm connected with a floatation mass 144 in a manner that the floatation mass floats on or near the surface of the water and applies an upward force on cuff 50. Because floatation mass 144 is maintained on the water surface, the bicep/tricep float is hydrodynamically configured to facilitate movement through the water. Floatation mass 44, 144 may be supplied in different buoyancy forces to allow the bicep/tricep float to be fitted to the size and/or skill level of the swimmer.

Changes and modifications in the specifically described embodiments can be carried out without departing from the principles of the invention which is intended to be limited only by the scope of the appended claims, as interpreted according to the principles of patent law including the Doctrine of Equivalents.

What is claimed is:

1. A swim stroke trainer apparatus, comprising:

a forearm paddle adapted to be connected with a swimmer's forearm, said forearm paddle including a hand portion contacting a swimmer's hand and a forearm portion contacting a swimmer's forearm, said hand portion including a stabilizer grip to be gripped by a swimmer's hand, said forearm portion including a connector connecting said forearm portion with a swimmer's forearm, wherein relative motion between the hand and forearm is limited, wherein said forearm paddle includes a throat extending between the stabilizer grip and the forearm portion and having a resistance surface adjacent said fin, said resistance surface applying pressure to the forearm, said forearm paddle including a fin extending forwardly at an angle away from the forearm portion and configured to convert generally forward motion into a generally downward force thereby promoting a downward motion of the hand and forearm; and a bicep/tricep float adapted to be connected with a swimmer's upper arm, said bicep/tricep float promoting an elevated elbow.

2. The trainer apparatus of claim 1 wherein said member grip is laterally inclined.

3. The trainer apparatus of claim 1 wherein said connector comprises at least one strap.

4. The trainer apparatus of claim 1 including another connector connecting said bicep/tricep float with a swimmer's upper arm.

5. The trainer apparatus of claim 4 wherein said another connector comprises at least one strap.

6. The trainer apparatus of claim 5, wherein said bicep/tricep float comprises at least two arcuate portions and wherein said at least one strap interconnects said at least two arcuate portions.

7. The trainer apparatus of claim 1 wherein said bicep/tricep float comprises at least two arcuate portions.

8. The trainer apparatus of claim 1 including a pair of said forearm paddles, one for each of the swimmer's forearms.

9. The trainer apparatus of claim 1 including a pair of said bicep/tricep floats, one for each of the swimmer's upper arms.

10. A swim stroke trainer apparatus, comprising:

a forearm paddle adapted to be connected with a swimmer's forearm, said forearm paddle including a hand portion contacting a swimmer's hand and a forearm portion contacting a swimmer's forearm, said hand portion including a stabilizer grip to be gripped by a swimmer's hand, said forearm portion including a connector connecting said forearm portion with a swimmer's forearm, wherein relative motion between the hand and forearm is limited, wherein said forearm paddle includes a throat extending between the stabilizer grip the forearm portion and having a resistance surface adjacent said fin, applying pressure to the forearm, said forearm paddle including a fin extending forwardly at an angle away from the forearm portion and configured to convert generally forward motion into a generally downward force thereby promoting a downward motion of the hand and forearm; and a bicep/tricep float adapted to be connected with a swimmer's upper arm, said bicep/tricep float including a floatation mass having a hydrodynamically configured surface adapted to facilitate gliding through water, whereby said bicep/tricep float promotes an elevated elbow.

11. The trainer apparatus of claim 10 wherein said fin slopes downwardly or upwardly from said throat.

12. The trainer apparatus of claim 10 wherein said grip is laterally inclined.

13. The trainer apparatus of claim 10 wherein said connector comprises at least one strap.

14. The trainer apparatus of claim 10 including another connector connecting said bicep/tricep float with a swimmer's upper arm.

15. The trainer apparatus of claim 14 wherein said another connector comprises at least one strap.

16. The trainer apparatus of claim 15, wherein said bicep/tricep float comprises at least two arcuate portions and wherein said at least one strap interconnects said at least two arcuate portions.

17. The trainer apparatus of claim 10 wherein said bicep/tricep float comprises at least two arcuate portions.

18. The trainer apparatus of claim 10 including a pair of said forearm paddles, one for each of the swimmer's forearms.

19. The trainer apparatus of claim 10 including a pair of said bicep/tricep floats, one for each of the swimmer's upper arms.

* * * * *

UNITED STATES PATENT AND TRADEMARK OFFICE

CERTIFICATE OF CORRECTION

PATENT NO. : 6,743,023 B2
DATED : June 1, 2004
INVENTOR(S) : Thomas G. Topolski

It is certified that error appears in the above-identified patent and that said Letters Patent is hereby corrected as shown below:

Column 5,
Line 26, delete “member” after “said”.

Column 6,
Line 9, insert -- and -- after “grip”.
Line 10, insert -- said resistance surface -- after “fin,”.

Signed and Sealed this

Sixth Day of September, 2005

JON W. DUDAS
*Director of the United States Patent and Trademark Office*